US006747375B2

(12) United States Patent
Tanguay

(10) Patent No.: US 6,747,375 B2
(45) Date of Patent: Jun. 8, 2004

(54) TIME CONTROLS WITH ENHANCED TIMING RANGE

(75) Inventor: William P. Tanguay, Downers Grove, IL (US)

(73) Assignee: Ranco Incorporated of Delaware, Wilmington, DE (US)

( * ) Notice: Subject to any disclaimer, the term of this patent is extended or adjusted under 35 U.S.C. 154(b) by 0 days.

(21) Appl. No.: 09/903,368

(22) Filed: Jul. 11, 2001

(65) Prior Publication Data

US 2002/0005669 A1 Jan. 17, 2002

Related U.S. Application Data

(60) Provisional application No. 60/218,406, filed on Jul. 14, 2000.

(51) Int. Cl.[7] ..... H01H 19/14

(52) U.S. Cl. ..... 307/115; 219/719; 219/492

(58) Field of Search ..... 307/132 R, 132 E, 307/140, 141, 141.4; 200/14, 18; 236/46 R; 361/202; 219/715, 718, 719, 492

(56) References Cited

U.S. PATENT DOCUMENTS

| | | | | | |
|---|---|---|---|---|---|
| 3,653,699 | A | * | 4/1972 | Podesta et al. | 290/37 R |
| 3,697,770 | A | * | 10/1972 | Murata et al. | 307/141.4 |
| 3,723,676 | A | | 3/1973 | Harris | 200/39 R |
| 3,768,469 | A | * | 10/1973 | Myers | 128/205.23 |
| 3,992,960 | A | * | 11/1976 | Rulseh | 361/202 |
| 4,011,517 | A | | 3/1977 | Pommerening et al. | 328/130 |
| 4,022,075 | A | * | 5/1977 | Schuder et al. | 74/437 |
| 4,100,505 | A | | 7/1978 | Belt et al. | 331/71 |
| 4,176,785 | A | * | 12/1979 | Allard et al. | 236/46 R |
| 4,224,484 | A | * | 9/1980 | Haas et al. | 200/307 |
| 4,227,062 | A | * | 10/1980 | Payne et al. | 219/486 |
| 4,354,120 | A | * | 10/1982 | Schornack | 307/132 E |
| 4,360,739 | A | * | 11/1982 | Goldstein | 200/293 |
| 4,430,540 | A | * | 2/1984 | Scalf | 219/506 |
| 4,439,688 | A | * | 3/1984 | Schornack | 307/115 |
| 4,591,831 | A | * | 5/1986 | D'Anci | 323/257 |
| 4,634,985 | A | | 1/1987 | Sasaki | 328/129.1 |
| 4,678,930 | A | * | 7/1987 | Mahon | 200/38 B |
| 5,443,487 | A | | 8/1995 | Guilbert et al. | 607/101 |
| 5,845,132 | A | | 12/1998 | Walsh et al. | 395/733 |
| 6,007,693 | A | * | 12/1999 | Silveri | 205/335 |
| 6,262,497 | B1 | * | 7/2001 | Muroi et al. | 307/116 |
| 6,275,018 | B1 | * | 8/2001 | Telefus et al. | 323/222 |

* cited by examiner

*Primary Examiner*—Gregory J. Toatley, Jr.
*Assistant Examiner*—Sharon A. Polk
(74) *Attorney, Agent, or Firm*—Andrus, Sceales, Starke & Sawall, LLP

(57) ABSTRACT

A time control unit having both a time base dial that allows the user to set the cycle time duration and a duty cycle dial that allows the user to set the percentage of time a load connected to the time control unit in activated during each cycle time. The time base dial includes a series of discrete time base settings that increase non-linearly from a minimum setting to a maximum setting. The duty cycle dial also includes a series of discrete duty cycle settings ranging between a maximum and a minimum duty cycle value. The amount of increase in the percentage of the cycle time between successive duty cycle settings is smaller near the minimum (0%) and maximum (100%) settings and larger near the midpoint between the minimum and the maximum settings such that the duty cycle dial has greater resolution near the maximum and minimum settings.

10 Claims, 9 Drawing Sheets

| TIMEBASE DIAL | | | | |
|---|---|---|---|---|
| Position | Hours | Minutes | Seconds | Hours |
| 1 | | | 15 | 0.00417 |
| 2 | | | 30 | 0.00833 |
| 3 | | 1 | | 0.01667 |
| 4 | | 2 | | 0.03333 |
| 5 | | 3 | | 0.05000 |
| 6 | | 4 | | 0.06667 |
| 7 | | 5 | | 0.08333 |
| 8 | | 6 | | 0.10000 |
| 9 | | 8 | | 0.13333 |
| 10 | | 10 | | 0.16667 |
| 11 | | 15 | | 0.25000 |
| 12 | | 20 | | 0.33333 |
| 13 | | 25 | | 0.41667 |
| 14 | | 30 | | 0.50000 |
| 15 | | 40 | | 0.66667 |
| 16 | | 45 | | 0.75000 |
| 17 | | 50 | | 0.83333 |
| 18 | | 60 | | 1.00000 |
| 19 | 1 | 30 | | 1.50000 |
| 20 | 2 | 0 | | 2.00000 |
| 21 | 2 | 30 | | 2.50000 |
| 22 | 3 | 0 | | 3.00000 |
| 23 | 3 | 30 | | 3.50000 |
| 24 | 4 | 0 | | 4.00000 |
| 25 | 6 | 0 | | 6.00000 |
| 26 | 8 | 0 | | 8.00000 |
| 27 | 10 | 0 | | 10.00000 |
| 28 | 12 | 0 | | 12.00000 |
| 29 | 16 | 0 | | 16.00000 |
| 30 | 18 | 0 | | 18.00000 |
| 31 | 20 | 0 | | 20.00000 |
| 32 | 24 | 0 | | 24.00000 |

FIG. 8a

| DUTY CYCLE DIAL | | | |
|---|---|---|---|
| Position | Linear Precentage | Non-linear Precentage ("S" curve) | Logarithmic Precentage |
| 1 | 0% | 0% | 0.01% |
| 2 | 1% | 1% | 0.12% |
| 3 | 3% | 2% | 0.16% |
| 4 | 7% | 3% | 0.20% |
| 5 | 10% | 4% | 0.24% |
| 6 | 13% | 5% | 0.30% |
| 7 | 17% | 8% | 0.38% |
| 8 | 20% | 10% | 0.48% |
| 9 | 23% | 13% | 0.59% |
| 10 | 27% | 15% | 0.74% |
| 11 | 30% | 20% | 0.93% |
| 12 | 33% | 25% | 1.16% |
| 13 | 37% | 30% | 1.45% |
| 14 | 40% | 35% | 1.81% |
| 15 | 43% | 40% | 2.26% |
| 16 | 47% | 50% | 2.83% |
| 17 | 50% | 60% | 3.53% |
| 18 | 53% | 65% | 4.42% |
| 19 | 57% | 70% | 5.52% |
| 20 | 60% | 75% | 6.90% |
| 21 | 63% | 80% | 8.62% |
| 22 | 67% | 85% | 10.77% |
| 23 | 70% | 88% | 13.46% |
| 24 | 73% | 90% | 16.82% |
| 25 | 77% | 93% | 21.02% |
| 26 | 80% | 94% | 26.26% |
| 27 | 83% | 95% | 32.82% |
| 28 | 87% | 96% | 41.01% |
| 29 | 90% | 97% | 51.25% |
| 30 | 93% | 98% | 64.04% |
| 31 | 97% | 99% | 80.03% |
| 32 | 100% | 100% | 100.00% |

FIG. 8b

TIME CONTROLS WITH ENHANCED TIMING RANGE

The present invention is based on and claims priority to U.S. Provisional Application Serial No. 60/218,406, filed Jul. 14, 2000.

BACKGROUND OF THE INVENTION

The present invention generally relates to time controls, such as repeat cycle timers or interval timers. More specifically, the present invention relates to a time control that includes a non-linear cycle time setting and a duty cycle setting such that the time control provides a broad range of timing capability.

In the early days of timer design, mechanical timers were available that were driven by synchronous AC motors to provide a means to generate "repeat cycle timing" of a load. These same types of synchronous motors also provided a means to generate "interval timing". The time base in each of the time controls was generally set by the motor and a set of appropriate gears to slow down the motor rotation speed to the desired final speed. In the early days of timer design, adjustable mechanical cams and similar apparatus could be attached to revolving pieces of the control and these links enabled the user to adjust the duty cycle or interval time. However, the basic time base was very fixed and related to the final rotational speed of the "setting wheel".

As timer design evolved, it became advantageous for designers and manufacturers to use analog oscillators as the adjustable time base for various time keeping functions. One common type of analog oscillator coupled a potentiometer to a knob with a printed time scale showing the approximate time on the face plate of the timer. The printed time scale served as a means to enable a widely variable time base that was not expected to be repeatable or extremely accurate for both repeat cycle times and interval timers.

As time keeping technology continued to evolve, it became advantageous for designers and manufacturers to use digital countdown circuits that were synchronized to accurate crystal time bases or an AC power line. Digital countdown circuits are typically found in either discrete digital logic components or can be implemented by software running within a microcomputer. In either case, these techniques offered a means to provide an accurate and repeatable timing function for both the repeat cycle timers and interval timers.

As shown in FIG. 1, a conventional repeat cycle timer can include two rotary knobs 12 and 14 that allow a user to set an "ON" time and an "OFF" time independently of each other. In the sample of the prior art illustrated in FIG. 1, each of the rotary time setting knobs 12 and 14 includes a linear time range spanning between 30 seconds and 15.5 minutes in thirty-two equally spaced steps of 30 second resolution. Thus, when utilizing the repeat cycle timer 10 illustrated in FIG. 1, the user can set a time base for the complete cycle of a minimum of 60 seconds to a maximum of 31 minutes and a duty cycle of 3.3% to 96.8%. In this control configuration, the user can select a desired repeating time base by summing the "ON" time and the "OFF" time of each rotary knob 12 and 14. Similarly, the duty cycle (or active load percentage) can be set comparing the ratio of the "ON" rotary knob 12 and the "OFF" rotary knob 14.

When utilizing the rotary timer 10 of the prior art, if the user needs a repeating time base of one minute, each knob of the cycle time could be set to 30 seconds. At this minimum value, there would be only one percentage setting available—50% duty cycle since the minimum resolution for each knob 12 and 14 is 30 seconds. In a second example, if the repeating time base was required to be two minutes, the sum of the settings of both knobs 12 and 14 could be set for that two minute requirement. In the prior art repeat cycle timer 10 illustrated in FIG. 1, three options would then be 30 seconds "ON" and 90 seconds "OFF" (25% duty cycle), 60 seconds "ON" and 60 seconds "OFF" (50% duty cycle), and 90 seconds "ON" and 30 seconds "OFF" (75% duty cycle). These two examples illustrate that the ultimate flexibility of the variable percentages is limited by the necessary choice of the time base. Secondly, unless the user carries a calculator, the mental math required to calculate the percentage duty cycle may be quite difficult. For example, 3.5 minutes "ON" and 13 minutes "OFF" requires a mental calculation of (3.5)/(3.5+13.0)=21.2%.

Therefore, it is an object of the present invention to provide a time control unit that allows the user greater flexibility, convenience and independence in setting both the repeating time base and the percentage duty cycle. It is a further object of the invention to provide a time control unit that includes one knob to define a timing range that grows in a non-linear manner from a relatively small minimum time to a relatively large maximum time. Further, it is an object of the present invention to provide a second knob that allows the user to define the duty cycle in a non-linear manner, preferably with greater resolution between 1% and 10% and 90% to 100% duty cycle. Further, it is an object of the present invention to present a time control unit that presents the user with an easy to understand determination of both the repeating time base and the load duty cycle.

SUMMARY OF THE INVENTION

The present invention relates to a time control unit that has a time base dial to set overall cycle time and a duty cycle dial to control the percent of the cycle time that a load is energized.

The time base dial of the time control unit is used to set the overall cycle time and includes a plurality of individual time base settings that increase in a non-linear manner from a minimum setting to a maximum setting. In one specific example of the invention, the values for each discrete position of the time base dial can be used to set the cycle time between a low value of 15 seconds and a high value of 24 hours. The individual settings between the high and low value generally increase in an exponential manner such that several decades of values can be represented over the thirty-two discrete settings for the time base dial.

The time control unit further includes a duty cycle dial that allows the user to accurately set the percentage of the cycle time which the load is activated. The duty cycle dial includes a plurality of discrete positions that allow the user to accurately determine the percentage of time the load is activated during the overall cycle time. The individual positions for the duty cycle dial can increase from a minimum setting to a maximum setting in either a linear manner or a non-linear manner, depending upon the user requirements. In one embodiment of the invention, the settings for the duty cycle dial include higher resolution near the 0% and 100% settings and a lower resolution near the 50% setting. Alternatively, the settings can be selected to increase generally exponentially to provide very high resolution near either the 100% or 0% settings, depending upon the user requirements.

The time control unit of the present invention includes a control unit that calculates and controls the cycle time and duty cycle based upon the settings of the time base dial and the duty cycle dial. The control unit polls each of the rotary switches that serve as the time base dial and the duty cycle dial to determine the current position of each dial. Based upon the current position of the dial, the control unit counts the required times and operates a relay circuit coupled to the control unit. The relay circuit, when closed, provides power to a load. The control unit can be programmed to allow the settings of both the time base dial and the duty cycle dial to be adjusted to any selected values such that the time control unit of the present invention can provide the user with extremely accurate and variable settings for both cycle time and the duty cycle.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIGS. 8*a* and 8*b* are tables illustrating the time base and duty cycle values for each of the discrete positions of the rotary dials on the time control unit of the present invention;

DETAILED DESCRIPTION OF THE INVENTION

Figure 1:
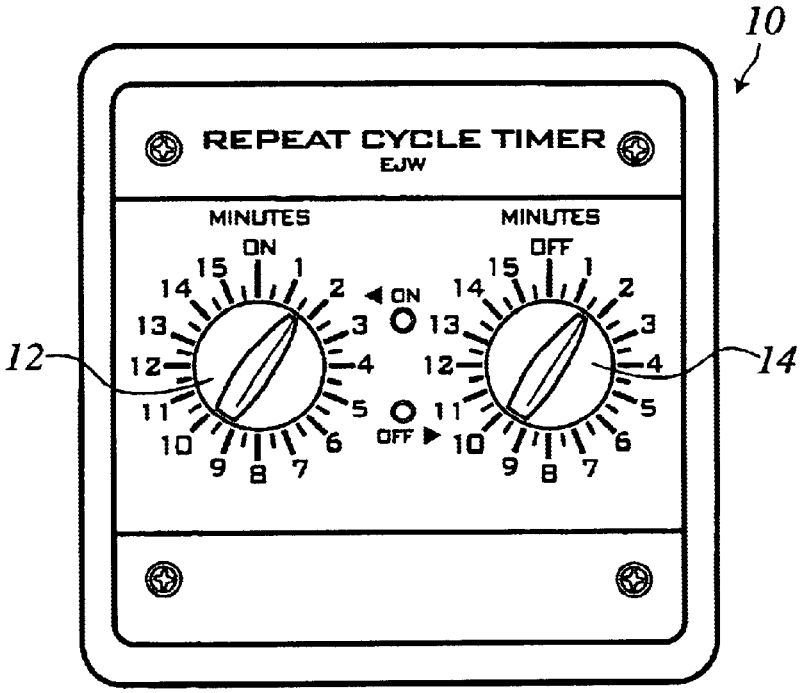
FIG. 1 PRIOR ART
FIG. 1 is a front view illustrating a representative time control unit of the prior art.
Figure 2:
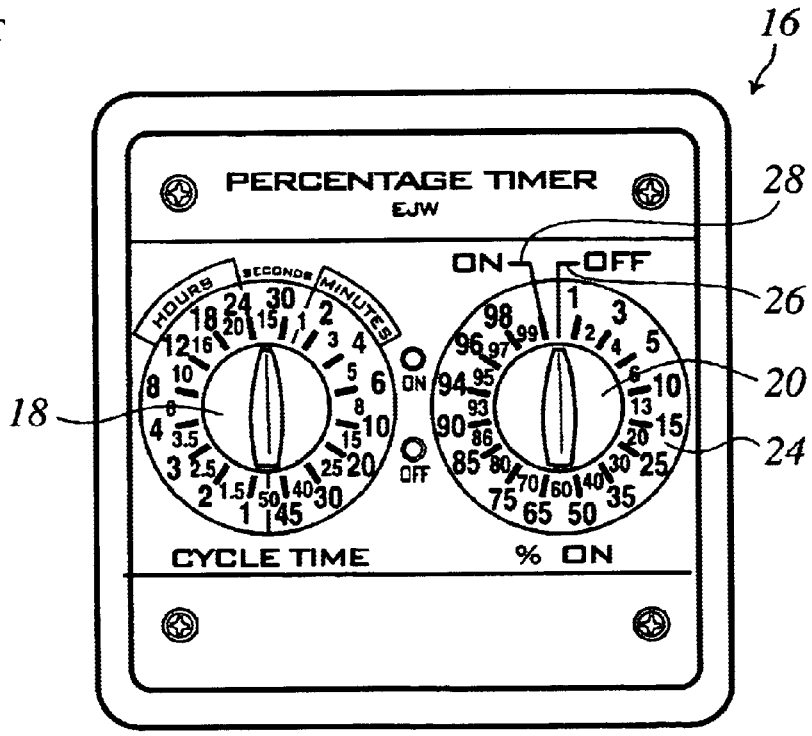
FIG. 2 is a front view of a time control unit of the present invention having a pair of rotary knobs that control the repeating time base and the duty cycle.

Referring first to FIG. 2, thereshown is a time control unit 16 of the present invention. The time control unit 16 includes an internal relay circuit that is opened and closed by the electronics contained within the time control unit 16. The internal relay within the time control unit 16 is coupled to an electronic device or load that is desired to be cycled "ON" and "OFF" for a selected duty cycle over a predetermined repeating time base. As can be seen in FIG. 2, the time control unit 16 of the present invention includes a rotary time base dial 18 and a rotary duty cycle dial 20 each of which are rotatable over 360°.

The time base dial 18 allows the user to select between thirty-two individual settings that define the length of the time base for each cycle controlled by the time control unit 16. The time base dial 18 includes a printed display 22 having a series of markings around the outer circumference of the time base dial 18 that clearly display to the user the length of time represented by each discrete position of the time base dial 18. In the preferred embodiment of the invention, the time base dial 18 is a digital switch or encoder that includes thirty-two discrete positions around the outer circumference of the time base dial 18. Each of the thirty-two positions for the time base dial 18 is defined by a detent such that the time base dial 18 snaps into one of the defined positions around the outer circumference, each of which is identified by the printed display 22.

Figure 4:
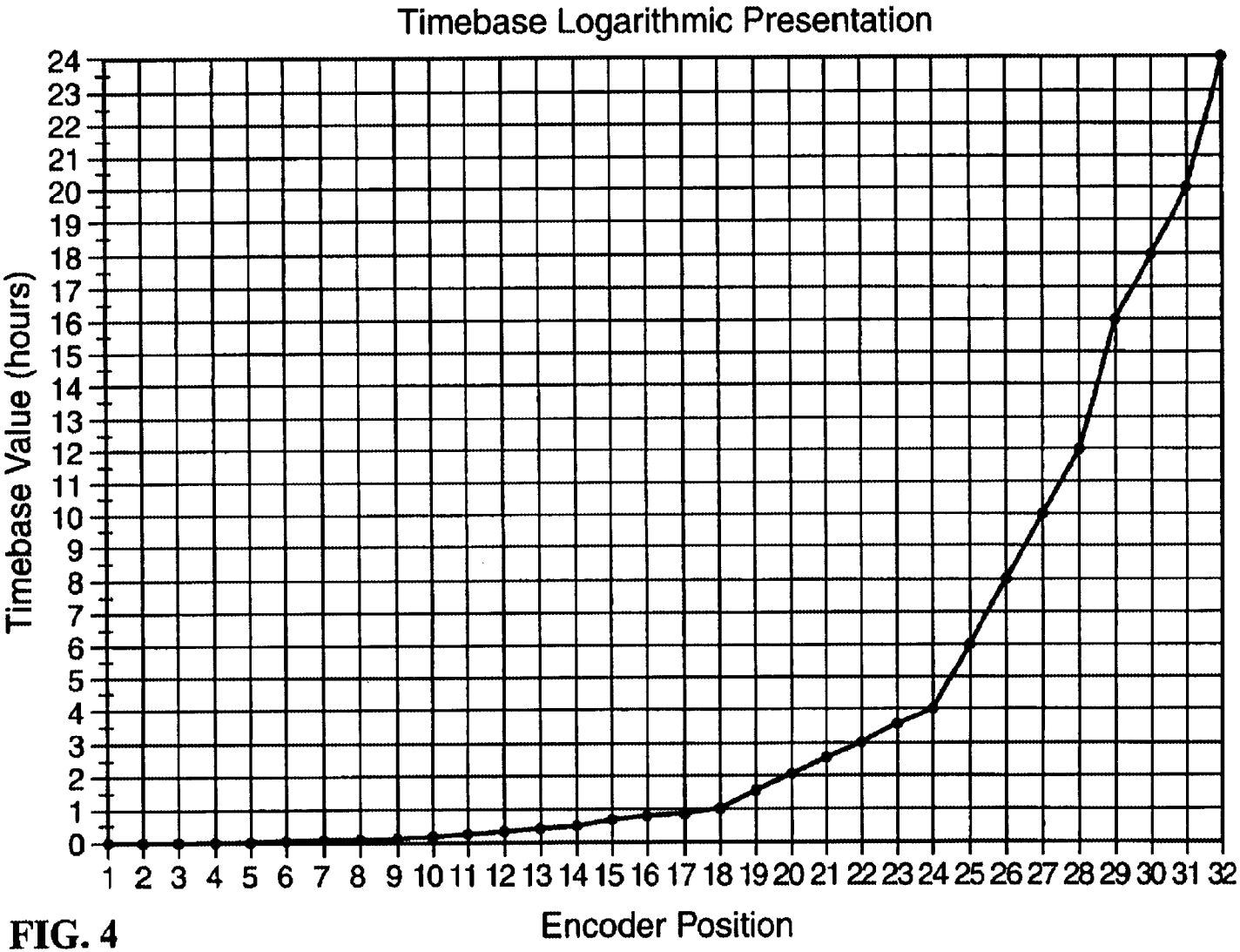
FIG. 4 is a graph illustrating the repeating time base for each of the discrete positions equally spaced around the rotary time base dial of the time control unit.

As can be seen in FIGS. 2 and 4 and the table of FIG. 8*a*, the thirty-two discrete positions for the time base dial 18 define a timing range that grows non-linearly from a minimum time base setting to a maximum time base setting. Although the specific time range of 15 seconds to 24 hours is illustrated in the preferred embodiment of the invention, it should be understood that the selected minimum and maximum values for the time base settings can be modified, as will become apparent in the discussion below.

Figure 5:
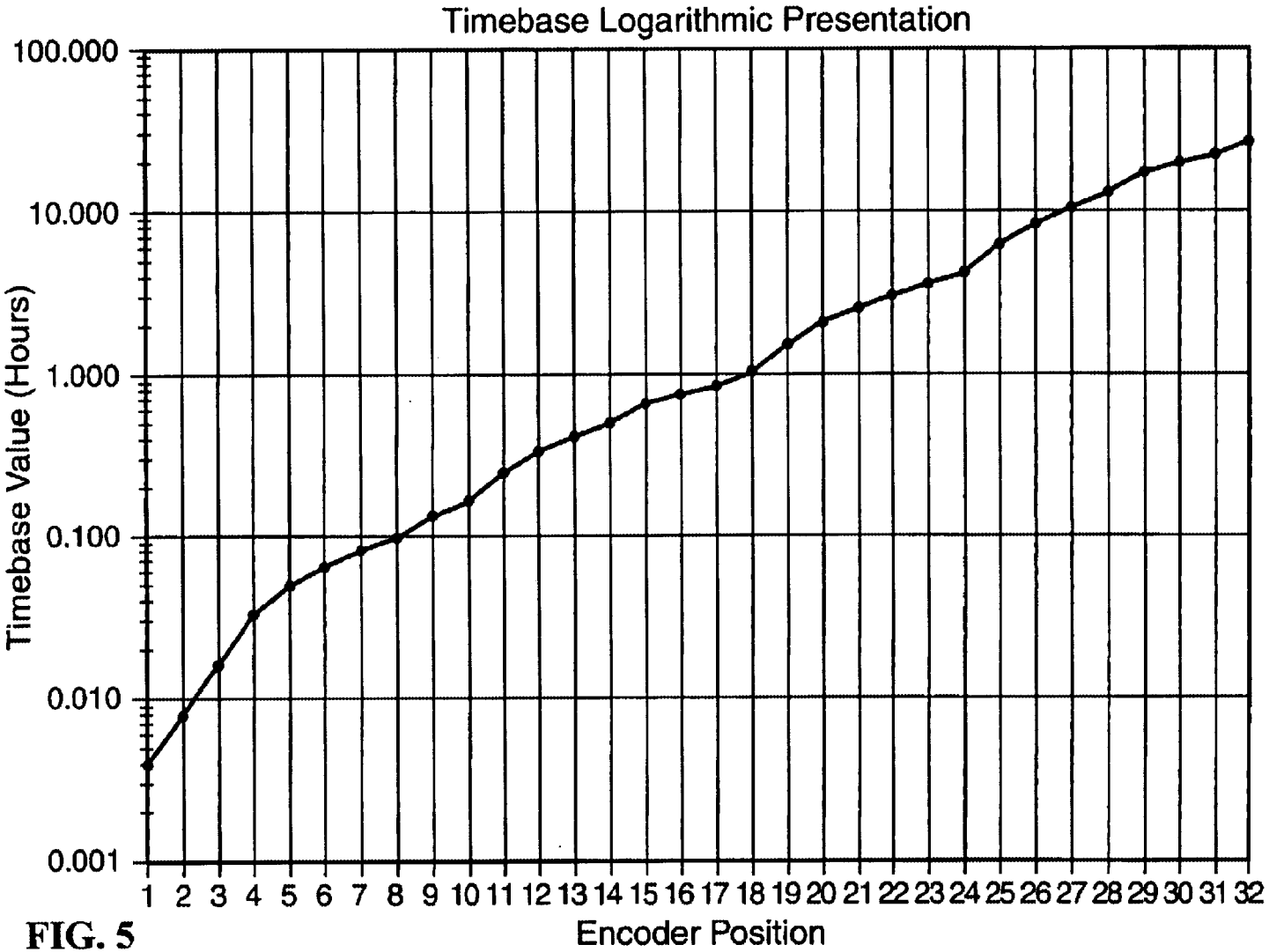
FIG. 5 is a logarithmic graph illustrating the repeating time base value for each of the discrete positions of the rotary time base dial of the time control unit.

Referring now to FIG. 5, it can be seen that the values for the time base dial 18 for each of the thirty-two positions of the time base dial 18 increase in a non-linear, generally exponential fashion. The use of the generally exponential increase in the value of the time base settings around the outer circumference of the time base dial 18 allows the time control unit 16 to be used over a much larger range of time base values (several decades in the illustrated embodiment) as compared to the prior art cycle timers that included a linear progression of time base values around the outer circumference of the time base dial.

Referring back to FIG. 2, the duty cycle dial 20 of the time control unit 16 also includes a printed display 24 that identifies the thirty-two discrete positions for the duty cycle dial 20. Like the time based dial 18, the duty cycle dial 20 is a digital switch or encoder that includes thirty-two discrete positions around its outer circumference. Each of the thirty-two positions for the duty cycle dial 20 is defined by a detent such that the duty cycle dial 20 snaps into one of the defined positions around the outer circumference, each of which are identified by the printed display 24.

As discussed previously, the duty cycle dial 20 allows the user to select the percentage of time the device attached to the time control unit 16 is turned on during the cycle time set by the time base dial 18. For example, if the time base dial 18 is set for a cycle time of ten minutes and the duty cycle dial 20 is set for 35%, the device attached to the time control unit 16 will be activated for the first 3.5 minutes, or 35%, of the ten minute cycle time. The load will then be deactivated for the next 6.5 minutes of the ten minute cycle. After the remaining 6.5 minutes of the cycle time expire, the time control unit 16 will begin a new cycle and the device will again be operated for the first 3.5 minutes of the second cycle.

As can be seen in FIG. 2, the duty cycle dial 20 includes a constant "OFF" position 26 and a constant "ON" position 28. The remaining thirty discrete positions between the constant "OFF" 26 and the constant "ON" 28 can be divided using several different methods. For example, in a first contemplated configuration, the thirty positions between the constant "OFF" position 26 and the constant "ON" position 28 can be divided in a generally linear manner, as illustrated by the linear percentage line 30 shown in FIG. 6. As the linear percentage line 30 indicates, each of the discrete settings for the duty cycle dial 20 increase in a linear manner from the second position to the thirty-first position. The linear percentage line 30 is also tabulated in FIG. 8*b* for the thirty-two discrete positions of the duty cycle dial 20. The linear percent progression around the duty cycle dial 20 allows the user to increase the duty cycle by a selected amount for each clockwise position increase of the duty cycle dial 20.

Figure 6:
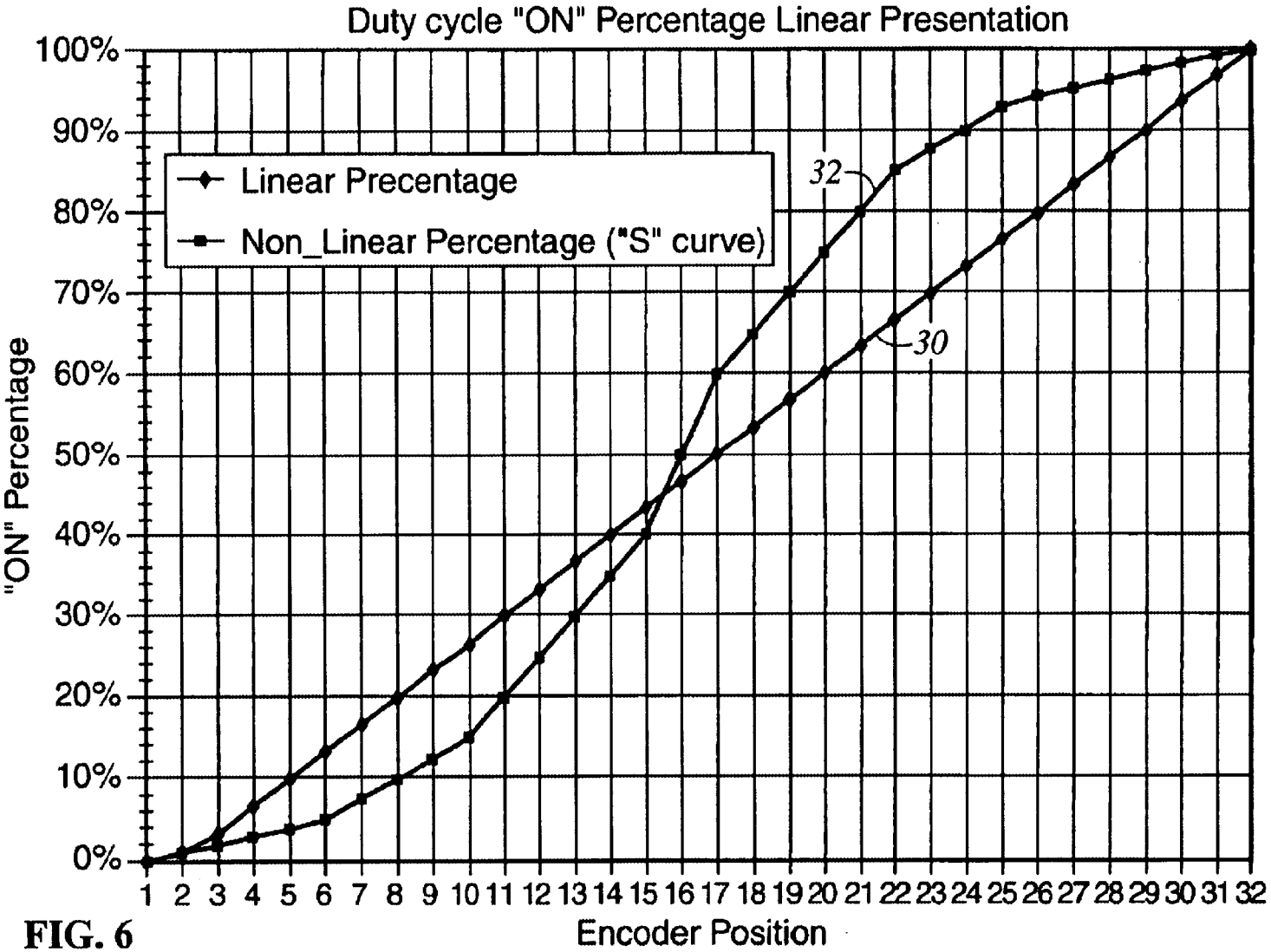
FIG. 6 is a graph illustrating two separate, alternate settings for the discrete positions of the rotary cycle time dial that sets the duty cycle percentage for the time control unit of the present invention.

In a second improved and preferred embodiment of the invention, the thirty positions for the duty cycle dial 20 between the constant "OFF" 26 and the constant "ON" 28 are arranged in a non-linear progression such that enhanced resolution is available near both the 0% and the 100% positions. The non-linear calibration for the duty cycle dial 20 is illustrated by the non-linear percentage curve 32 of FIG. 6. As can be seen in FIG. 6, the non-linear percentage curve 32 has a generally "S" curve with increased resolution between approximately the first and tenth positions and the $22^{nd}$–$32^{nd}$ positions of the duty cycle dial. The duty cycle dial 20 has lower resolution centered around the 50% duty cycle setting, as can be seen in FIG. 6. The "S" curve of the non-linear percentage line 32 allows the user to have greater flexibility in selecting the percentage of the duty cycle at percentages near 0% and 100%. The selection of the "S" curve is based upon the desire of typical users to have a large number of choices for selecting the percentage of the time base for the duty cycle near the minimum and maximum values. The specific percentages for the second, preferred embodiment of the invention are shown in tabular form in FIG. 8 and in graphic form on the printed display 24 illustrated in FIG. 2.

Figure 7:
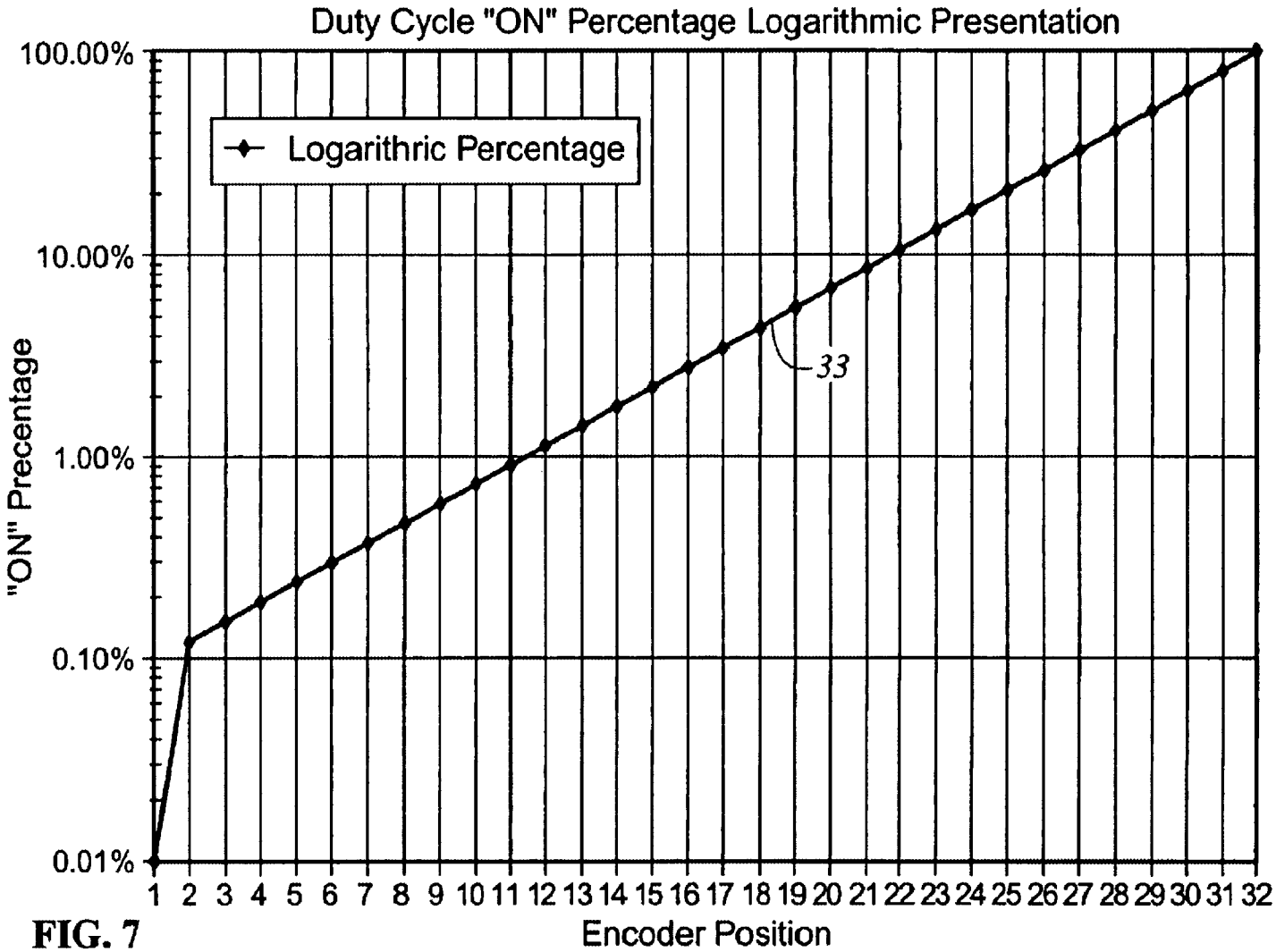
FIG. 7 is a graph illustrating a further alternate setting for the discrete positions for the rotary cycle time dial that sets the duty cycle percentage in which the cycle time varies on an exponentially increasing percentage.

Referring now to FIG. 7, thereshown is a third embodiment of the invention in which the thirty settings around the duty cycle dial 20 are calibrated using an exponential percentage line 33. As can be seen by examining FIG. 7 and the tabular presentation of FIG. 8, the resolution of the duty cycle dial 20 is dramatically increased near the 0% or "OFF" position 26. Specifically, the first twenty-two settings around the outer circumference of the duty cycle dial 20 represent 10% of the duty cycle, while the remaining ten settings represent the other 90% of the duty cycle. In this manner, the resolution near 0% is greatly increased while the resolution near 100% is very low. Additionally, it is contemplated by the inventor that the exponential percentage curve 33 illustrated in FIG. 7 could be reversed such that the timer would have very enhanced resolution near 100% and have very low resolution near 0%, depending upon the requirements of the user.

Figure 3A:
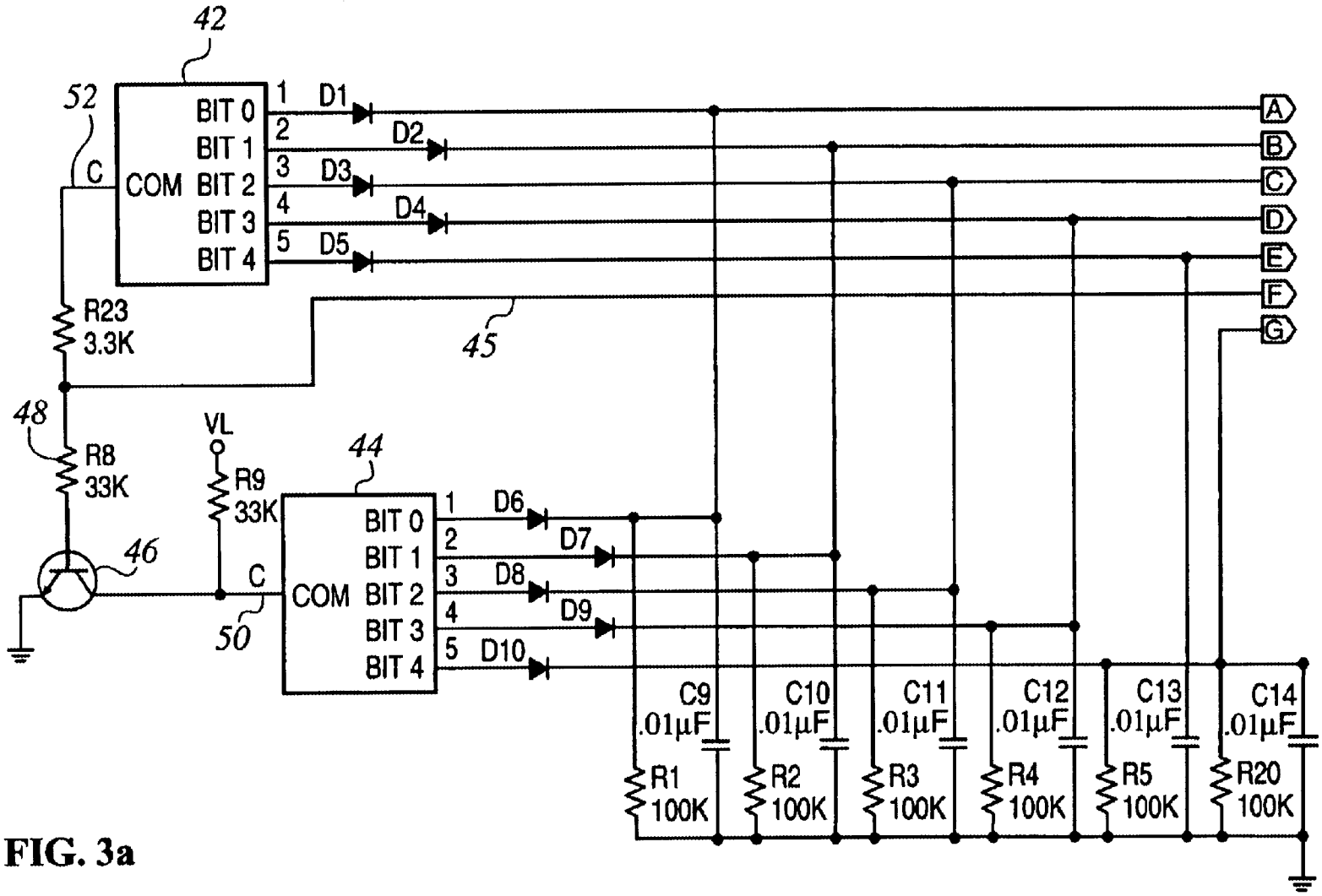
FIGS. 3*a* and 3*b* are detailed circuit schematics illustrating the operating configuration for the time control unit of the present invention.
Figure 3B:
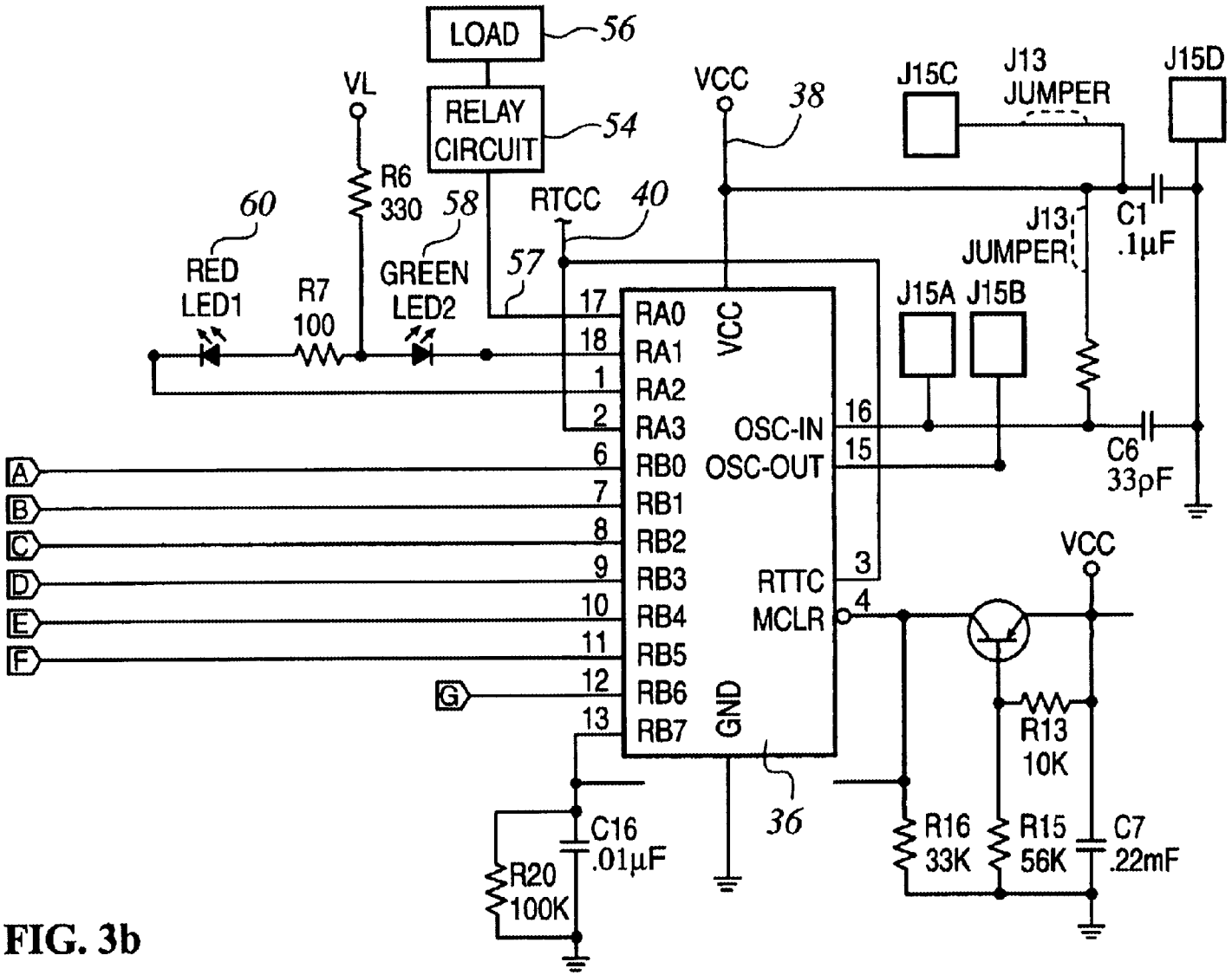

Referring now to FIGS. 3*a* and 3*b*, thereshown is the detailed circuit schematic that controls the operation of the time control unit 16 of the present invention. The time control unit 16 is controlled by a control unit 36. Control unit 36 of the present invention is Model No. 16C54-RCI/P, available from Microchip Corporation. The control unit 36 is operated by a power supply 38, which is preferably +5 volts DC. The control unit 36 includes an internal clock that operates based upon a real time clock signal received on line 40. The real time clock signal received on line 40 is derived from the 60 Hz AC power supply connected to the time control unit and used to operate the load connected to the time control unit. The real time clock signal present at line 40 is a very accurate signal that allows the control unit 36 to provide dependable and accurate timing control.

The control unit 36 is connected to a first rotary switch 42, which functions as the time base dial, and a second rotary switch 44, which functions as the duty cycle dial. Each of the rotary switches 42 and 44 includes five output lines that each represent a digital bit. The five output lines allow each of the rotary switches 42 and 44 to provide a 5-bit digital signal to the control unit 36. The 5-bit output signal from each of the rotary switches 42 and 44 allows each of the rotary switches to define the thirty-two individual positions of both the time base dial and the duty cycle dial. The output of each of the rotary switches 42 and 40 is determined by the position of the rotary dial in both the time base dial and the duty cycle dial.

During operation of the time control unit, the control unit 36 periodically applies a high signal to the output pin 45, which is connected to the base of transistor 46 through the resistor 48. When a high signal is applied to pin 45, transistor 46 becomes saturated such that pin 50 of rotary switch 44 is essentially grounded. At the same time, the pin 52 of rotary switch 42 receives the high signal from output pin 45. The high value of pin 52 of rotary switch 42 signals the rotary switch 42 to transmit a digital binary signal to control unit 36. Thus, when pin 45 of control unit 36 is high, the control unit 36 polls the rotary switch 42 to determine the position of the time base dial.

When the high signal is removed from pin 45 of the control unit 36, the rotary switch 42 stops transmitting its five bit binary signal. At the same time, the low signal is applied to the base of transistor 46 which causes the transistor 46 to act as an open circuit. The open circuit results in voltage VL is applied to pin 50 of the rotary switch 44. The high value at pin 50 causes the rotary switch 44 to send a binary signal representing the position of the duty cycle dial to the control unit 36. In this manner, the control unit 36 alternately polls each of the rotary switches 42 and 44 to determine their current position.

Control unit 36 includes internal programming that allows the control unit to have a time base value assigned to each discrete position of the rotary switch 42 and a duty cycle percentage assigned to each discrete position of the rotary switch 44. Thus, the specific values for each setting of both the time base dial and the duty cycle dial can be easily programmed into the control unit 36 and can be configured to create time control units having differing operating characteristics.

In order to determine the selected time base value and the selected duty cycle value, the control unit 36 simply determines the current position of both of the rotary switches 42 and 44 and compares these current positions to the table of values stored within the control units internal programming. After determining the position of both of the rotary switches 42 and 44, the internal timing structure within the control unit 36 provides an accurate time count to create both the overall cycle time and operates the load for the selected duty cycle. Since each of the rotary switches 42 and 44 generates a digital signal based upon the plurality of discrete settings, the control unit 36 provides an extremely accurate time count based upon the user's selection.

The control unit 36 is connected to a conventional relay circuit 54, which is in turn connected to the control the load 56. The control unit 36 generates a high signal on pin 57 to activate the relay circuit 54 and thus turn on the load 56. The high signal on pin 57 of the control unit 36 is controlled by the internal programming and timer within the control unit 36.

The control unit 36 is connected to a green LED 58 and a red LED 60. The green LED 58 is activated when the load 56 is turned on, while the red LED 60 is activated during the remaining portion of each duty cycle when the load 56 is inactive.

As can be understood by the circuit diagram of FIG. 3, each setting on both the time base dial and the duty cycle dial, which correspond to the rotary switches 42 and 44, is a non-ambiguous and extremely accurate setting that sends a digital 5-bit signal to microcontroller 36. Based upon these extremely accurate settings for both of the rotary switches 42 and 44, the microcontroller 36 digitally calculates the time values selected by the time base dial and the duty cycle dial. In this manner, the time base value and duty cycle percentage are highly accurate and extremely repeatable.

Referring back to FIG. 2, the user is presented with a pair of dials 18 and 20 that each include an easy to understand printed display that allow the user to easily determine both the time base of a complete cycle and percent the load will be on during the time base cycle. In the embodiment of the invention illustrated in FIG. 2, the user is presented with an accurate time control unit that has an exponential range of settings that spans several decades for the time base range. Additionally, the user is presented with a duty cycle dial that presents the user with a non-linear setting having higher resolution near the 0% and 100% settings and the lower resolution around the 50% duty cycle.

Although the present invention is illustrated in the Figures for a repeat cycle timer including both a time base dial 18 and a duty cycle dial 20, it is contemplated by the inventor that the concept of including a non-linear time range assigned to the thirty-two discrete positions of each dial could also be applied to a non-repeating, "one shot" timer. Such a timer is typically used for creating a delay before turning on a device or delaying the shutdown of one electric device compared to another. A "one shot" timer would include a single time base dial that includes discrete time settings separated from each other in a non-linear manner, similar to the time settings on the time base dial 18 of FIG. 2. For example, a time base dial that includes non-linear spacing between the discrete time settings would allow the time dial to create time representations between five seconds and three hours.

Various alternatives and embodiments are contemplated as being within the scope of the following claims particularly pointing out and distinctly claiming the subject matter regarded as the invention.

I claim:

1. A timer for controlling the activation of a load during repeating cycles, the timer including:

a control unit having an internal timer;

a relay unit connected between the control unit and the load, wherein the control unit activates the relay unit to supply power to the load;

a time base dial coupled to the control unit, the time base dial movable between a plurality of discrete time base settings to set the duration of the repeating cycle in the control unit, wherein the time base settings increase non-linearly from a minimum setting to a maximum setting; and a duty cycle dial coupled to the control unit, the duty cycle dial movable between a plurality of discrete duty cycle settings to set the percentage of actuation time of the load during each cycle in the control unit, wherein duty cycle settings increase non-linearly from a minimum setting of 0% and a maximum setting of 100%, and wherein the amount of increase in the percentage between successive duty cycle settings is smaller near both the minimum setting and the maximum setting and larger near a midpoint between the minimum and maximum settings such that the duty cycle dial has greater resolution near the minimum and maximum settings.

2. The timer of claim 1 wherein the maximum time base setting is at least as large as 24 hours and the minimum time base settings is at least as small as 30 seconds.

3. The timer of claim 1 wherein the time base dial generates a digital signal defining thirty-two discrete time base setting.

4. The timer of claim 1 wherein the time base settings increase generally exponentially between the minimum setting and the maximum setting.

5. A timer for controlling the activation of a load during repeating cycles, the timer including:

a control unit having an internal timer;

a relay unit connected between the control unit and the load, wherein the control unit activates the relay unit to supply power to the load;

a time base dial coupled to the control unit, the time base dial movable between a plurality of discrete time base settings to set one of a plurality of different durations for the repeating cycle in the control unit such that a user can select between the plurality of durations by moving the time base dial between the plurality of time base settings, wherein the time base settings increase non-linearly from a minimum setting to a maximum setting; and a duty cycle dial coupled to the control unit, the duty cycle dial movable between a plurality of discrete duty cycle settings to set one of a plurality of different percentages of actuation time of the load during each repeating cycle in the control unit, wherein the duty cycle settings increases exponentially from a minimum setting to a maximum setting such that the duty cycle dial has greater resolution near the minimum setting compared to the resolution near the maximum setting such that the user can select between the plurality of percentages by moving the duty cycle dial between the plurality of duty cycle settings, wherein the duration of the repeating cycle is selectable independently from the percentage of actuation time of the load.

6. A timer for controlling the activation of a load during repeating cycles, the timer including:

a time base dial movable between a plurality of discrete time base settings to set the duration of the repeating cycle between a maximum setting and a minimum setting;

a duty cycle dial movable between a plurality of discrete duty cycle settings to set the percentage of actuation time of the load during each repeating cycle between a maximum setting and a minimum setting, wherein duty cycle settings increase non-linearly from minimum setting of 0% and the maximum setting of 100%, and wherein the amount of increase in the duty cycle value between successive duty cycle settings is smaller near both the minimum duty cycle setting and the maximum duty cycle setting and the amount of increase in the duty cycle valve between successive duty cycle settings is larger near a midpoint between the minimum and maximum duty cycle settings such that the duty cycle dial has greater resolution near the minimum and maximum duty cycle settings;

a control unit coupled to both the time base dial and the duty cycle dial, the control unit assigning a time base value corresponding to the duration of the repeating cycle for each time base setting and a duty cycle value corresponding to the percentage of actuation for each duty cycle setting, wherein the time base values increase non-linearly from the minimum time base setting to the maximum time base setting; and a relay unit coupled between the control unit and the load, the relay unit being activated by the control unit to supply power to the load based upon the time base value and the duty cycle value corresponding to the current settings of the time base dial and the duty cycle dial.

7. The timer of claim 6 wherein the time base dial generates a digital signal having thirty-two discrete time base settings.

8. The timer of claim 6 wherein the time base values increase exponentially between the minimum setting and the maximum setting.

9. A timer for controlling the activation of a load during repeating cycles, the timer including:

a time base dial movable between a plurality of discrete time base settings to set one of a plurality of different durations for the repeating cycle between a maximum setting and a minimum setting;

a duty cycle dial movable between a plurality of discrete duty cycle settings to set one of a plurality of different percentages of actuation time of the load during each repeating cycle between a maximum setting and a minimum setting, wherein the duty cycle values decrease exponentially from the minimum duty cycle setting to the maximum duty cycle setting such that the duty cycle dial has greater resolution near the minimum setting compared to the maximum setting, wherein the duration of the repeating cycle is selectable independently from the percentage of actuation time of the load during each repeating cycle;

a control unit coupled to both the time base dial and the duty cycle dial, the control unit assigning one of a plurality of time base values corresponding to the duration of the repeating cycle set by the selected time base setting and one of a plurality of duty cycle values corresponding to the percentage of actuation set by the selected duty cycle setting, wherein the time base values increase non-linearly from the minimum time base setting to the maximum time base setting; and a relay unit coupled between the control unit and the load, the relay unit being activated by the control unit to supply power to the load based upon the time base value and the duty cycle value corresponding to the current settings of the time base dial and the duty cycle dial.

10. A timer for controlling the activation of a load during repeating cycles, the timer including:

a time base dial movable between a plurality of discrete time base settings to set one of a plurality of different durations for the repeating cycle between a maximum setting and a minimum setting;

a duty cycle dial movable between a plurality of discrete duty cycle settings to set one of a plurality of different percentages of actuation time of the load during each repeating cycle between a maximum setting and a minimum setting, wherein the duty cycle values decrease exponentially from the maximum duty cycle setting to the minimum duty cycle setting such that the duty cycle dial has greater resolution near the maximum setting compared to the minimum setting, wherein the duration of the repeating cycle is selectable independently from the percentage of actuation time of the load during each repeating cycle;

a control unit coupled to both the time base dial and the duty cycle dial, the control unit assigning one of a plurality of time base values corresponding to the duration of the repeating cycle set by the selected time base setting and one of a plurality of duty cycle values corresponding to the percentage of actuation set by the selected duty cycle setting, wherein the time base values increase non-linearly from the minimum time base setting to the maximum time base setting; and a relay unit coupled between the control unit and the load, the relay unit being activated by the control unit to supply power to the load based upon the time base value and the duty cycle value corresponding to the current settings of the time base dial and the duty cycle dial.

* * * * *